US006431462B1

(12) United States Patent
Apostolou et al.

(10) Patent No.: US 6,431,462 B1
(45) Date of Patent: Aug. 13, 2002

(54) RAILROAD CROSSING SPACERS

(75) Inventors: George Apostolou; Isidoros Garifalakis; Adolfo Bella, all of Vancouver, WA (US)

(73) Assignee: Omega Industries, Inc., Vancouver, WA (US)

( * ) Notice: Subject to any disclaimer, the term of this patent is extended or adjusted under 35 U.S.C. 154(b) by 0 days.

(21) Appl. No.: 09/377,301

(22) Filed: Aug. 18, 1999

Related U.S. Application Data

(60) Provisional application No. 60/097,439, filed on Aug. 21, 1998.

(51) Int. Cl.[7] ..... E01B 1/00

(52) U.S. Cl. ..... 238/8; 238/2; 238/6; 238/7

(58) Field of Search ..... 238/7, 8, 84, 105, 238/2, 6

(56) References Cited

U.S. PATENT DOCUMENTS

| | | | | | |
|---|---|---|---|---|---|
| 1,672,752 | A | * | 6/1928 | Coppock | 238/8 |
| 2,929,562 | A | * | 3/1960 | Hosbein | 238/8 |
| 3,353,747 | A | * | 11/1967 | Speer | 238/8 |
| 4,236,670 | A | | 12/1980 | Limmergard et al. | 238/8 |
| 4,365,743 | A | | 12/1982 | Trickel et al. | 238/8 |
| 4,372,488 | A | | 2/1983 | Schonthaler et al. | 238/8 |
| 4,415,120 | A | | 11/1983 | Thim | 238/8 |
| 4,449,666 | A | | 5/1984 | Hales et al. | 238/84 |
| 4,461,421 | A | | 7/1984 | Maass | 238/8 |
| 4,606,498 | A | | 8/1986 | Grant et al. | 238/8 |
| 4,846,401 | A | | 7/1989 | Kennel | 238/7 |
| 4,860,952 | A | | 8/1989 | Schmidt | 238/8 |
| 4,880,158 | A | | 11/1989 | Cook | 238/8 |
| 4,899,933 | A | | 2/1990 | Martin | 238/8 |
| 5,181,657 | A | | 1/1993 | Davis | 238/8 |
| 5,201,467 | A | | 4/1993 | Kennel et al. | 238/8 |
| 5,465,903 | A | | 11/1995 | Davis et al. | 238/8 |
| 5,535,947 | A | * | 7/1996 | Hogue et al. | 238/8 |
| 5,535,948 | A | | 7/1996 | Williams | 238/8 |
| 5,538,182 | A | * | 7/1996 | Davis et al. | 238/8 |
| 5,577,662 | A | * | 11/1996 | Hogue et al. | 238/8 |
| 5,740,961 | A | * | 4/1998 | Bruning | 238/8 |
| 6,079,630 | A | * | 6/2000 | Schroeder | 238/8 |

OTHER PUBLICATIONS

"Omega Crossings Attached Rubber Installation and Handling Instruction Manual", pp. 1–6.
Oldcastle, Precast, Inc., "Startrack Roadmaster Non–Crack Precast Concrete Lay–In Railroad Crossing Brochure", Aug. 1997, pp. 1–5.
"Premier Advanced Panel Specifications Pamphlet", pp. 1–2.
Railway Track and Structures, "Guide crossings: Surfaces and safety", Reprinted from RT&S Jun. 1996, pp. 1–4.
"Century Preminum Lagtype Crossing System Flyer", p. 1.
KSA, "Concrete Grade Crossing System", pp. 1–2.
Premier Concrete Railroad Crossings, "Advanced Panel Lag–Down System Product Data Sheet", 1996, pp. 1–3.
StarTrack Railroad Crossings, "StarTrack System Brochure", pp. 1–17.
Kraiburg of America, Inc., "PedeStrail Rubber Walkway System Flyer", p. 1.
Magnum Manufacturing Corporation, "Magnum Concrete Crossings Manual", pp. 1–3.
*RT&S Railway Track and Structures*, Aug. 1997, pp. 1–100.

* cited by examiner

*Primary Examiner*—S. Joseph Morano
*Assistant Examiner*—Lars A. Olson
(74) *Attorney, Agent, or Firm*—Marger Johnson & McCollom, P.C.

(57) ABSTRACT

A concrete gauge panel spans the gap between two parallel railroad tracks. Two concrete field panels lead from the roadway surface to the railroad tracks, one panel on each side of the railroad tracks. A spacer sits between the concrete of the concrete field and gauge panels and the railroad tracks. The spacer is affixed to the panels in a way that allows the spacer to be removed and replaced without replacing the entire panel.

10 Claims, 5 Drawing Sheets

RAILROAD CROSSING SPACERS

RELATED APPLICATION DATA

This application claims priority from U.S. Provisional Application No. 60/097,439, filed Aug. 21, 1998, incorporated by reference.

FIELD OF THE INVENTION

This invention relates generally to railroad grade crossings and, more particularly, to railroad grade crossings using concrete panels with polymeric, preferably elastomeric, seals between the panels and the rails.

BACKGROUND OF THE INVENTION

Where paved roads intersect with railroad crossings, vehicles need a simple way to cross the railroad tracks. The simplest solution uses concrete panels to span the gap between the rails. When the concrete panels are positioned with respect to the railroad tracks to match the elevation of the roadway, vehicles have a nearly continuous surface on which to travel over the tracks. However, if the rails and concrete panels directly abut each other, they can do damage to each other.

To avoid this problem, a gap needs to be maintained between the concrete panels and the rails. But leaving this gap unfilled allows water and debris to intersect with the ballast and ties of the track, which can damage the ties and ballast (rock placed below and between the railroad ties to provide a level surface on which to lay the track). To fill this gap, a flexible substance, such as a rubber spacer, is used, both to cushion the concrete panels and the rails and to limit the entry of water and debris.

Originally, the spacer was a separate element. The concrete panels were positioned between and around the rails, and then the spacer was carefully inserted therewithin. This made it possible to replace the spacer when it wore out, but necessitated a more complicated installation process. Later developments included permanently attaching the spacer to the concrete panels, making the two parts into a single piece. For example, the spacer could be permanently bolted to a completed concrete panel using a T-bar, or the concrete panel could be cast around the spacer. But when the spacer wore out, the entire panel had to be replaced, an expensive proposition.

SUMMARY OF THE INVENTION

The invention is directed to spacers and panel systems which form a paved road across railroad tracks. A concrete gauge panel is located between the rails. A panel system comprising a pair of gauge flangeway spacers are attached to the concrete gauge panel and form a cushion between the concrete gauge panel and the rails. The gauge flangeway spacers are preferably made of a resilient polymeric material and are removable. The gauge flangeway spacers are preferably offset downward from the top surface of the concrete gauge panel to allow train wheels to run properly on the tracks. The gauge flangeway spacer is typically shaped to match the contour of the rail at the point of contact. The complimentary shape of the gauge flangeway spacer helps prevent water and debris from getting under the panels and rails.

The gauge flangeway spacer preferably defines a longitudinal cavity into which a retaining bar can be inserted for securing the gauge flangeway spacer to the concrete gauge panel. The retaining bar includes a plurality of holes through which bolts can be inserted to secure the gauge flangeway spacer to the concrete gauge panel. The gauge flangeway spacer also preferably includes complementary holes through which bolts can be inserted to secure the gauge flangeway spacer to the concrete gauge panel.

A pair of concrete field panel systems is located outside the rails. The panel systems comprising a pair of field flangeway spacers attached to the concrete field panel cushion, the concrete field panel and the rails. The field flangeway spacers are also preferably made of a resilient polymeric material and are removable. The field flangeway spacer is also preferably shaped to match the contour of the rail at the point of contact. The shape of the field flangeway spacer helps prevent water and debris from getting under the panels and rails. The top surface of the field flangeway spacer can also be configured to increase crossing vehicles' traction.

The field flangeway spacer preferably defines a longitudinal cavity into which a retaining bar can be inserted for securing the field flangeway spacer to the concrete field panel. The retaining bar includes a plurality of holes through which bolts can be inserted to secure the field flangeway spacer to the concrete field panel. The field flangeway spacer also preferably includes complementary holes through which bolts can be inserted to secure the field flangeway spacer to the concrete field panel.

The invention also includes a method for replacing an attached gauge or field flangeway spacer. The gauge flangeway spacer is replaced by uninstalling the concrete gauge panel system. This may involve releasing the concrete gauge panel and attached spacer and lifting it from between the rails. The existing gauge flangeway spacer is removed from the concrete gauge panel, and a new gauge flangeway spacer is attached to the concrete gauge panel. An attachment mechanism, such as bolts or screws, can be used to reattach the gauge flangeway spacer to the concrete gauge panel. Finally, the concrete gauge panel and attached spacer is reinstalled between the rails.

The field flangeway spacer is replaced by uninstalling the concrete field panel system. This typically involves releasing the concrete field panel and sliding it away from the rail. The existing field flangeway spacer is removed from the concrete field panel and a new field flangeway spacer is attached thereto. An attachment mechanism, such as bolts or screws, can be used to attach the field flangeway spacer to the concrete field panel. Finally, the concrete field panel system is reinstalled next to the rails.

DETAILED DESCRIPTION OF THE PREFERRED EMBODIMENT

Figure 1:
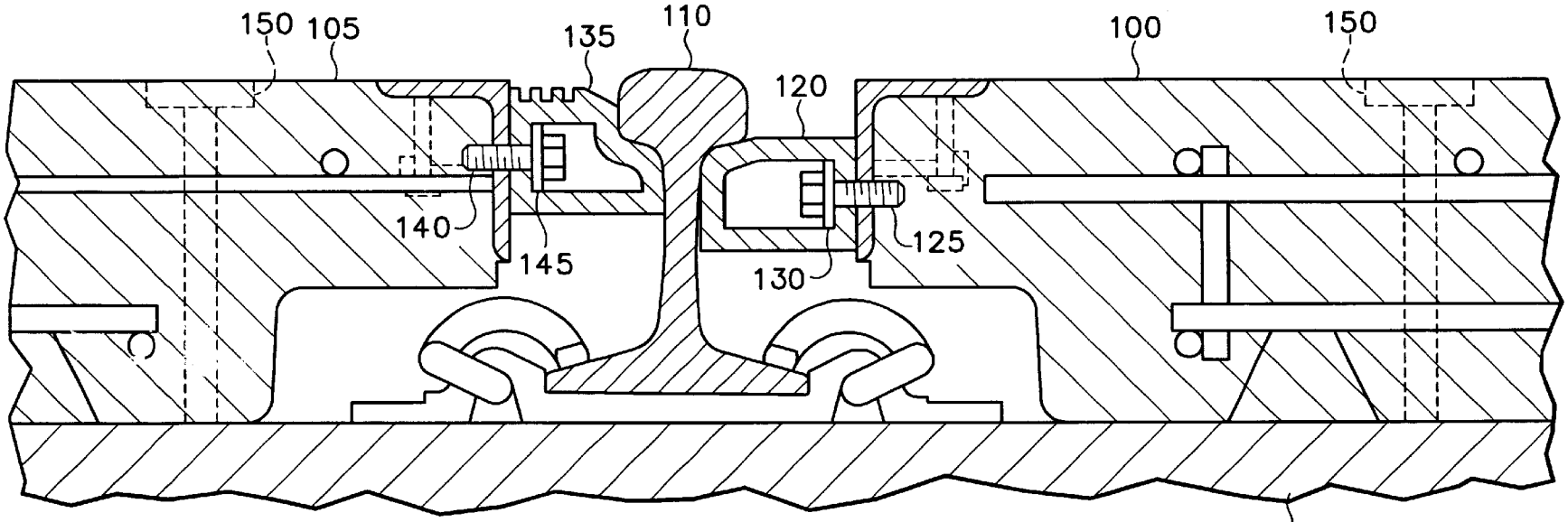
FIG. 1 shows a sectional view of the concrete gauge panel and one field panel at their point of contact with a rail.
Figure 2:
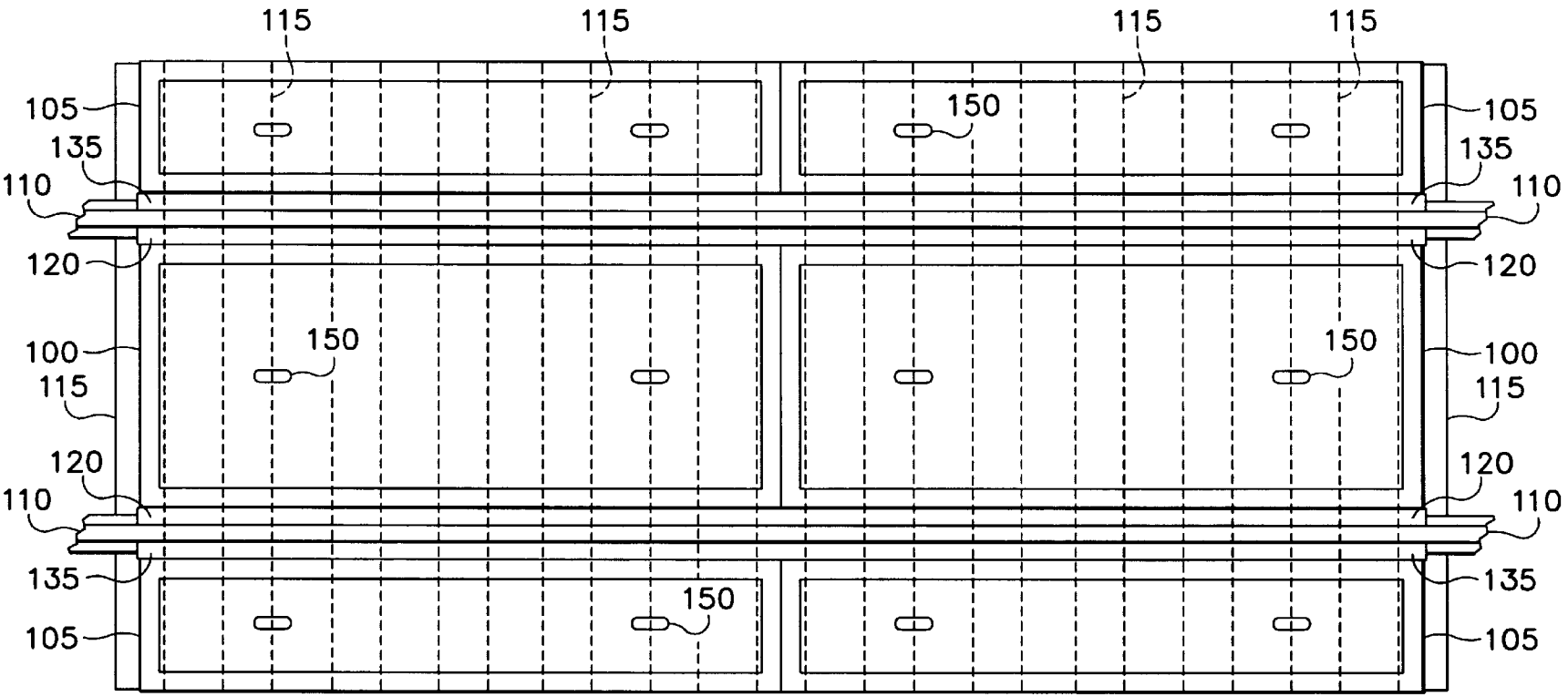
FIG. 2 shows a plan view of the concrete gauge panel and the field panels installed with respect to the rails.

FIGS. 1 and 2 shows a concrete gauge panel 100 and a concrete field panel 105 at their point of contact with a railroad track 110. The concrete gauge panel 100 and the concrete field panel 105 sit on the railroad tie 115 that supports the railroad track 110. Located between the concrete gauge panel 100 and the railroad track 110 is a gauge flangeway spacer 120. In the preferred embodiment, the gauge flangeway spacer 120 is typically made of a resilient polymeric material such as styrene-butadiene rubber, preferably having the following specifications: a Durometer of about 75–85 on the Shore "A" scale, a modulus of about 300%, a tensile strength of about 1600 psi, and an elongation of about 350%. However, other materials with similar cushioning properties may be used. In FIG. 1, the gauge flangeway spacer 120 is attached to the concrete gauge panel 100 by means of a bolt 125 and washer 130. However, other means can be used to attach the gauge flangeway spacer 120 to the concrete gauge panel 100.

The field flangeway spacer 135 is located between the concrete field panel 105 and the railroad track 110. In the preferred embodiment, the field flangeway spacer 135 is made of a resilient polymeric material as described above. In FIG. 1, the field flangeway spacer 135 is attached to the concrete field panel 105 by means of a bolt 140 and washer 145. However, other means can be used to attach the field flangeway spacer 135 to the concrete field panel 105. Also provided in the concrete gauge panel 100 and the concrete field panel 105 are tie holes 150 through which pins (not shown) can be driven to secure the panel to the railroad tie 115.

The advantage of affixing the spacer to the concrete panels as shown in FIGS. 1 and 2 is that it retains the installation ease of a single panel with attached cushioning without the disadvantage of having to replace the entire panel when the spacer wears out (saving money). When the spacer wears out, it is removed from the concrete panels and a new spacer is affixed to the concrete panels.

As shown in FIG. 1, the field flangeway spacer 135 can have a grooved surface. Longitudinal-grooves in the top surface of the field flangeway spacer provide passing vehicles better traction as they cross the railroad tracks and limit the entry of water and debris under the ties and ballast of the tracks.

As shown in FIG. 1, the gauge flangeway spacer 120 is offset downward from the upper surface of the concrete gauge panel 100. This offset is necessary to allow trains to run properly on the tracks.

Figure 3:
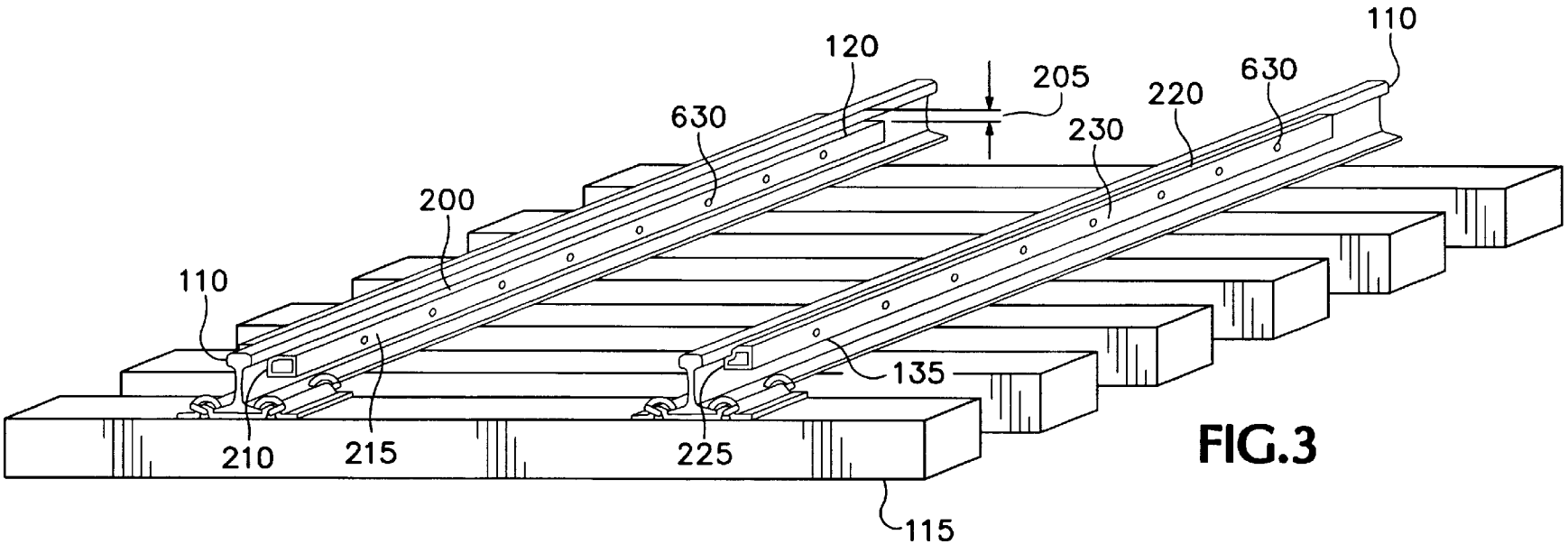
FIG. 3 shows a perspective view of the gauge flangeway spacer and field flangeway spacer.

FIG. 3 shows a perspective view of the gauge flangeway spacer 120 and field flangeway spacer 135. The gauge flangeway spacer 120 includes a top surface 200. The top surface 200 is offset 205 downward to provide to allow trains to run properly on the tracks 110. One side 210 of the gauge flangeway spacer 120 is contoured to match the inside counter of a rail 110. When properly installed, the contour of the gauge flangeway spacer 120 will exactly match the inside contour of the rail 110. This prevents water and debris from getting underneath the panels 100 and 105 and rails 110.

Opposite the contoured side 210, the gauge flangeway spacer 120 includes a mechanism 215 to attach the gauge flangeway spacer 120 to the concrete gauge panel 100. In the preferred embodiment, the mechanism 215 is a series of positioned holes that allow the gauge flangeway spacer 120 to be bolted to the concrete gauge panel 100. However, other mechanisms for removably securing the gauge flangeway spacer 120 to the concrete gauge panel 100 can be used.

The field flangeway spacer 135 includes a top surface 220. As discussed above, the top surface 220 can have longitudinal grooves to increase vehicle traction and to prevent water and debris from getting under the panels 100 and 105 and rails 110. One side 225 of the field flangeway spacer 135 is contoured to match the outside counter of a rail 110. When properly installed, the contour of the field flangeway spacer 135 will exactly match the outside contour of the rail 110. This also prevents water and debris from getting underneath the panels 100 and 105 and rails 110.

Opposite the contoured side 225, the field flangeway spacer 135 includes a mechanism 230 to attach the field flangeway spacer 135 to the concrete field panel 105. In the preferred embodiment, the mechanism 230 is a series of positioned holes that allow the field flangeway spacer 135 to be bolted to the concrete field panel 105. However, other mechanisms for removably securing the field flangeway spacer 135 to the concrete field panel 105 can be used.

Figure 4:
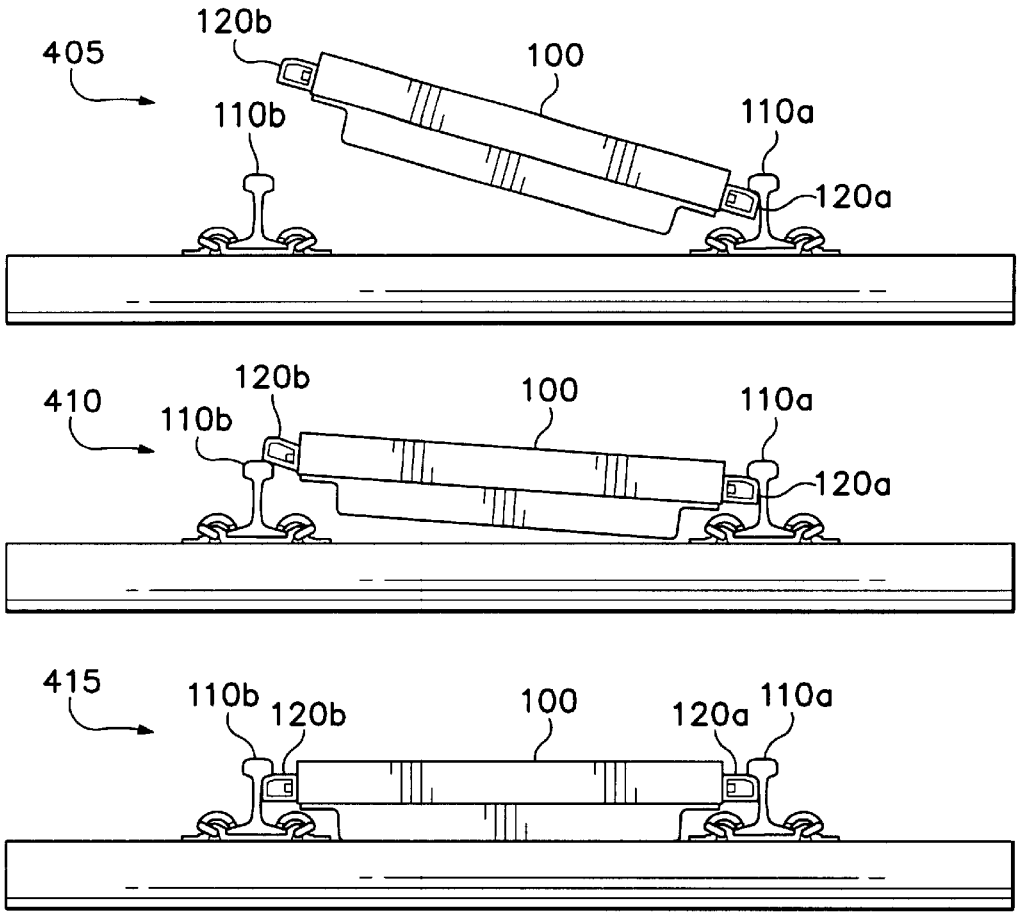
FIG. 4 shows a schematic of the method for installing the concrete gauge panel.

FIG. 4 shows how the concrete gauge panel 100 is installed between two rails. In step 405, one of the attached gauge flangeway spacers 120*a* is put in position underneath the lip of the rail 110*a*. Then in step 410 the concrete gauge panel 100 is lowered into position until the other gauge flangeway spacer 120*b* is touching the other rail 110*b*. In step 415 the other gauge flangeway spacer 120*b* is rolled under the lip of the rail 110*b*. Using a lubricant can make it easier to roll the gauge flangeway spacer 120*b* under the lip of the rail 110*b*. Finally, the concrete gauge panel 100 is centered between the rails 110*a* and 110*b* and secured in position. In the preferred embodiment, the concrete gauge panel 100 is secured to the railroad ties through lag screws, but other methods can be used to secure the concrete gauge panel 100.

Figure 5:
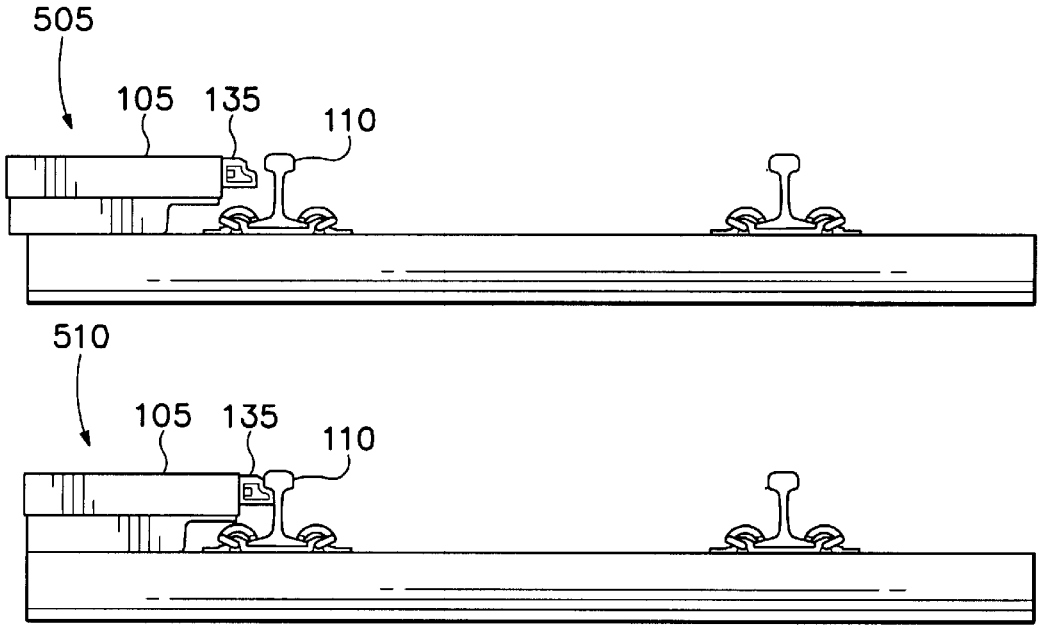
FIG. 5 shows a schematic of the method for installing the concrete field panels.

FIG. 5 shows how the concrete field panels 105 are installed. In step 505, the concrete field panel 105 is positioned a few inches away from the rail 110. Then in step 510, the concrete field panel 105 is slid toward the rail until the field flangeway spacer 135 touches the rail 110. The contour of the field flangeway spacer 135 should match the contour of the outside contour of the rail 110. Then the concrete field panel 105 can be secured. In the preferred embodiment, the concrete field panel 105 is secured by driving lag screws into railroad ties, but other methods of securing the concrete field panels 105 can be used.

Figure 6:
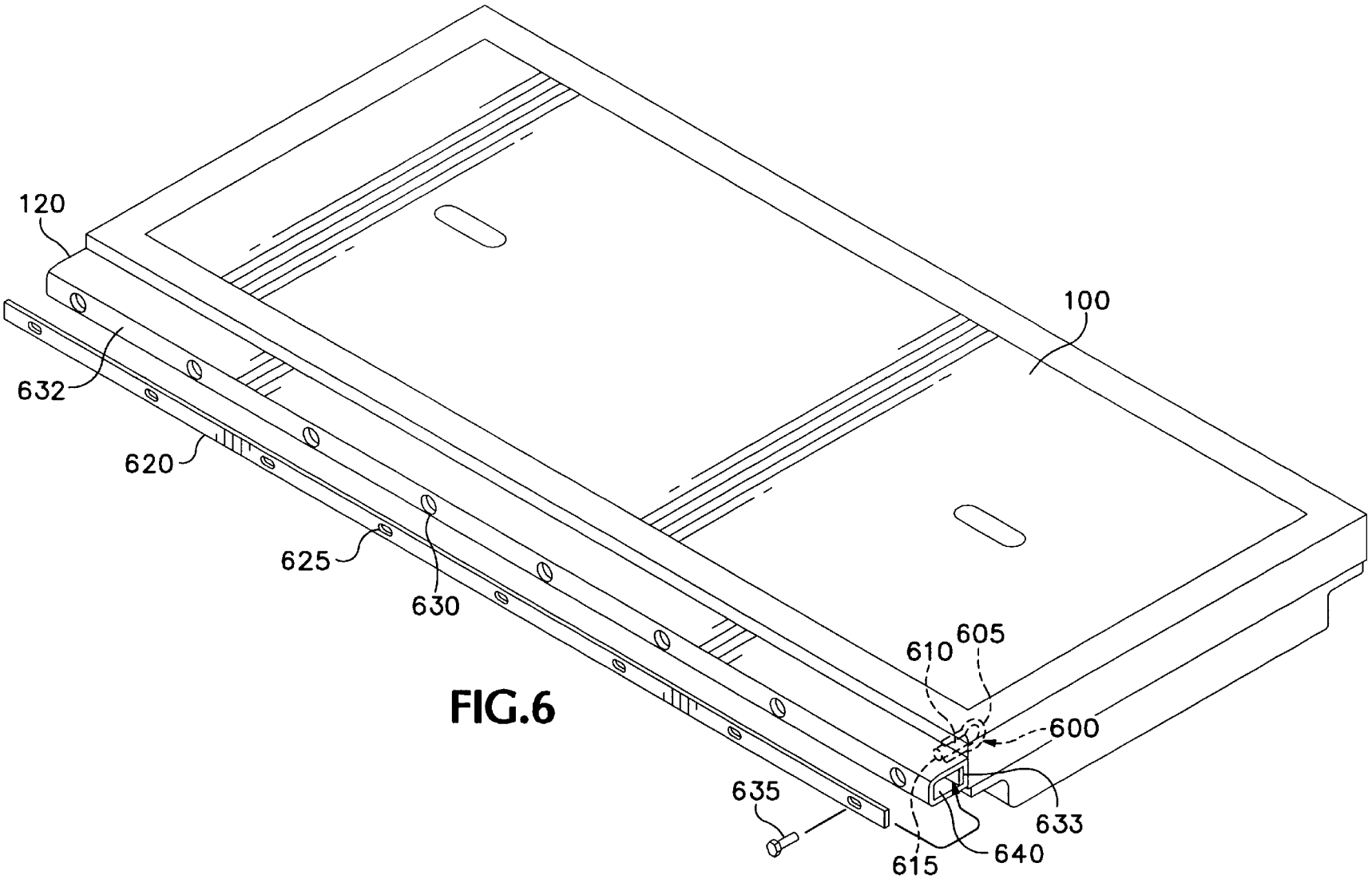
FIG. 6 shows a perspective view of how the gauge flangeway spacer is attached to the concrete gauge panel in the preferred embodiment.

FIG. 6 shows a perspective view of how the gauge flangeway spacer 120 is removably attached to the concrete gauge panel 100 in the preferred embodiment. (The field flangeway spacer 135, not shown, is attached to the concrete field panel 105, not shown, in a similar manner.) Embedded within the concrete gauge panel 100 is a ferrel loop 600 (alternatively spelled as ferrule loop insert). The ferrel loop 600 includes a steel frame 605 to which concrete nuts 610 are welded. The concrete gauge panel also has holes 615 that lead into the concrete nuts 610. A retainer bar 620 is part of the mechanism that attaches the gauge flangeway spacer 120 to the concrete gauge panel 100. The retainer bar 620 has holes 625 drilled through the retainer bar. The holes 625 can be slot-shaped to allow the retainer bar to be adjusted after the gauge flangeway spacer 120 is placed in position. Finally, the gauge flangeway spacer 120 has holes 630 drilled through. (Only holes in the outer wall 632 of the gauge flangeway spacer 120 are shown, but there are corresponding holes in the inner wall 633.) These holes 630 allow bolts 635 to be used to secure the gauge flangeway spacer 120 to the concrete gauge panel. The holes 630 can be oversize holes, both to allow the bolts 635 and a wrench (not shown) to be used to secure the gauge flangeway spacer 120 to the concrete gauge panel 100 and to allow the gauge flangeway spacer 120 to be adjusted. Preferably, the holes 630 in the inner and outer walls 633 and 632 are the same diameter. The concrete nuts 610 and the holes 625 and 630 are preferably spaced every 12 inches on center.

To secure the gauge flangeway spacer 120 to the concrete gauge panel 100, first the retainer bar 620 is placed in the longitudinal cavity 640 of the gauge flangeway spacer 120. The bolts 635 pass through the holes 630 in the outer wall 632 of the gauge flangeway spacer 120, then through the holes 625 in the retainer bar 620, and lastly through the holes 630 in the inner wall 633 of the gauge flangeway spacer 120. The bolts 635 are tightened on the concrete nuts 610 to secure the gauge flangeway spacer 120 to the concrete gauge panel 100.

To replace an old gauge flangeway spacer 120 on a concrete gauge panel 100, first the concrete gauge panel 100 is uninstalled from between the railroad tracks. Next, the old gauge flangeway spacer 120 is removed from concrete gauge panel 100. This is accomplished by removing the bolts 635 securing the gauge flangeway spacer 120 to the concrete gauge panel 100. Then a new gauge flangeway spacer 120 is attached to the concrete gauge panel 100 as discussed above. Finally, the concrete gauge panel 100 is reinstalled between the railroad tracks. The method for replacing a field flangeway spacer is similar to that for replacing the gauge flangeway spacer.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A railroad crossing spacer system for extending a paved roadway surface across a pair of parallel separated rails, comprising:

a concrete gauge panel extending substantially between the rails, wherein the concrete gauge panel includes:

at least one ferrule loop insert set internal to one end of the concrete gauge panel for receiving a bolt and removably attaching a gauge flangeway spacer to one end of the concrete gauge panel;

at least one bolt mating to the ferrule loop insert to removably attach the gauge flangeway spacer to the concrete gauge panel; and at least one flat bar providing support for the gauge flangeway spacer along an axis of the concrete gauge panel, the flat bar with at least one hole, the bolt designed to pass through the hole of the flat bar, a pair of gauge flangeway spacers, one gauge flangeway spacer being removably attached to each end of the concrete gauge panel, and located between the concrete gauge panel and one of the rails;

a pair of concrete field panels extending between each rail and the paved roadway; and a pair of field flangeway spacers, removably attached to one end of each concrete field panel, and located between the concrete field panel and one of the rails.

2. A railroad crossing spacer system according to claim 1, wherein:

the ferrule loop insert includes a female thread; and the bolt includes a male thread designed to mate with the female thread of the ferrule loop insert.

3. A railroad crossing spacer system for extending a paved roadway surface across a pair of parallel separated rails, comprising:

a concrete gauge panel extending substantially between the rails;

a pair of gauge flangeway spacers, one gauge flangeway spacer being removably attached to each end of the concrete gauge panel, and located between the concrete gauge panel and one of the rails;

a pair of concrete field panels extending between each rail and the paved roadway, wherein the concrete field panel includes:

at least one ferrule loop insert set internal to the end of the concrete field panel for receiving a bolt and removably attaching a field flangeway spacer to one end of the concrete field panel;

at least one bolt mating to the ferrule loop insert to removably attach the field flangeway spacer to the concrete field panel; and at least one flat bar providing support for the field flangeway spacer along an axis of the concrete field panel, the flat bar with at least one hole, the bolt designed to pass through the hole of the flat bar; and a pair of field flangeway spacers, removably attached to one end of each concrete field panel, and located between the concrete field panel and one of the rails.

4. A railroad crossing spacer system according to claim 3, wherein:

the ferrule loop insert includes a female thread; and the bolt includes a male thread designed to mate with the female thread of the ferrule loop insert.

5. A concrete gauge panel assembly comprising:

a concrete gauge panel, wherein the concrete gauge panel includes a pair of ends;

a pair of gauge flangeway spacers, wherein each gauge flangeway spacer is removably attached to an end of the concrete gauge panel with an attachment mechanism, wherein the attachment mechanism includes a ferrule loop insert for bolting the gauge flangeway spacers to the concrete gauge panel, the ferrule loop insert set internal to one end of the concrete gauge panel; and at least one flat bar providing support for one of the gauge flangeway spacers along an axis of the concrete gauge panel, the flat bar with at least one hole, the attachment mechanism designed to pass through the hole of the flat bar.

6. A concrete field panel assembly comprising:

a concrete field panel, wherein the concrete field panel includes an end;

a field flangeway spacer, wherein the field flangeway spacer is removably attached to the end of the concrete field panel with an attachment mechanism, wherein the attachment mechanism includes a ferrule loop insert for bolting the field flangeway spacer to the concrete field panel, the ferrule loop insert set internal to the end of the concrete field panel; and at least one flat bar providing support for the field flangeway spacer along an axis of the concrete field panel, the flat bar with at least one hole, the attachment mechanism designed to pass through the hole of the flat bar.

7. A gauge flangeway spacer replacement method for replacing a first gauge flangeway spacer attached to a concrete gauge panel installed between a pair of parallel separated rails, the method comprising:

uninstalling the concrete gauge panel from between the pair of parallel separated rails;

unattaching the first gauge flangeway spacer from the concrete gauge panel, including removing an attachment mechanism affixing the first gauge flangeway spacer to the concrete gauge panel, including unscrewing one or more bolts affixing the first gauge flangeway spacer to the concrete gauge panel, including unscrewing one or more bolts from one or more ferrule loop inserts set internal to one end of the concrete gauge panel;

removing a flat bar providing support for the first gauge flangeway spacer along an axis of the concrete gauge panel;

inserting the flat bar into a second gauge flangeway spacer;

attaching the second gauge flangeway spacer to the concrete gauge panel; and reinstalling the concrete gauge panel between the pair of parallel separated rails.

8. A gauge flangeway spacer replacement method for replacing a first gauge flangeway spacer attached to a concrete gauge panel installed between a pair of parallel separated rails, the method comprising:

uninstalling the concrete gauge panel from between the pair of parallel separated rails;

unattaching the first gauge flangeway spacer from the concrete gauge panel;

removing a flat bar providing support for the first gauge flangeway spacer along an axis of the concrete gauge panel;

inserting the flat bar into a second gauge flangeway spacer;

attaching the second gauge flangeway spacer to the concrete gauge panel, including using an attachment mechanism to affix the second gauge flangeway spacer to the concrete gauge panel, including screwing one or more bolts to affix the second gauge flangeway spacer to the concrete gauge panel, including screwing one or more bolts to one or more ferrule loop inserts set internal to one end of the concrete gauge panel; and reinstalling the concrete gauge panel between the pair of parallel separated rails.

9. A field flangeway spacer replacement method for replacing a first field flangeway spacer attached to a concrete field panel installed next to a rail, the method comprising:

uninstalling the concrete field panel from next to the rail;

unattaching the first field flangeway spacer from the concrete field panel, including removing an attachment mechanism affixing the first field flangeway spacer to the concrete field panel, including unscrewing one or more bolts affixing the first field flangeway spacer to the concrete field panel, including unscrewing one or more bolts from one or more ferrule loop inserts set internal to an end of the concrete field panel;

removing a flat bar providing support for the first field flangeway spacer along an axis of the concrete field panel;

inserting the flat bar into a second field flangeway spacer;

attaching the second field flangeway spacer to the concrete field panel; and reinstalling the concrete field panel next to the rail.

10. A field flangeway spacer replacement method for replacing a first field flangeway spacer attached to a concrete field panel installed next to a rail, the method comprising:

uninstalling the concrete field panel from next to the rail;

unattaching the first field flangeway spacer from the concrete field panel;

removing a flat bar providing support for the first field flangeway spacer along an axis of the concrete field panel;

inserting the flat bar into a second field flangeway spacer;

attaching the second field flangeway spacer to the concrete field panel, including using an attachment mechanism to affix the second field flangeway spacer to the concrete field panel, including screwing one or more bolts to affix the second field flangeway spacer to the concrete field panel, including screwing one or more bolts to one or more ferrule loop inserts set internal to an end of the concrete field panel; and reinstalling the concrete field panel next to the rail.

* * * * *